US006164388A

United States Patent [19]

Martunovich et al.

[11] Patent Number: 6,164,388

[45] Date of Patent: Dec. 26, 2000

[54] ELECTROPULSE METHOD OF HOLES BORING AND BORING MACHINE

[75] Inventors: Adam Albert Martunovich; Vajov Vyacheslav Fedorovich, both of Tomsk, Russian Federation

[73] Assignee: ITAC Ltd., Niigata, Japan

[21] Appl. No.: 09/284,833

[22] PCT Filed: Jul. 7, 1997

[86] PCT No.: PCT/JP97/02345

§ 371 Date: Apr. 7, 1999

§ 102(e) Date: Apr. 7, 1999

[87] PCT Pub. No.: WO98/16713

PCT Pub. Date: Apr. 23, 1998

[30] Foreign Application Priority Data

Oct. 14, 1996 [RU] Russian Federation ..... 96120954

[51] Int. Cl.[7] ..... E21B 7/00; E21B 7/14

[52] U.S. Cl. ..... 175/1; 175/16; 299/17

[58] Field of Search ..... 175/1, 15, 16, 175/17, 67; 166/249, 65.1, 177.1; 299/14, 16, 17

[56] References Cited

U.S. PATENT DOCUMENTS

| | | | |
|---|---|---|---|
| 3,700,169 | 10/1972 | Nayden et al. | 239/15 |
| 3,840,270 | 10/1974 | Allgood | 299/16 X |
| 5,773,750 | 6/1998 | Jae et al. | 102/302 |
| 5,914,020 | 6/1999 | Griffith et al. | 166/245 |

*Primary Examiner*—Robert E. Pezzuto
*Attorney, Agent, or Firm*—Jordan and Hamburg LLP

[57] ABSTRACT

This invention provides an excavator 1 for crushing a matter to be excavated, existing in an excavating hole in which a discharge liquid is fed, by electric discharge between a plurality of electrodes generated by high-voltage pulses. The excavator comprises a high-voltage pulse generator 2; a plurality of electrodes 17, 18, at least one of which is given a high voltage from the high-voltage pulse generator 2; discharge liquid circulating system 3, 4, 5*a*, 5*b*; and optimum condition setting devices 13, 14, 15, 16. Also, this invention provides an excavation method in which at least one of the parameters for excavation efficiency of i) load voltage required for crushing the matter to be excavated; ii) single pulse energy; and iii) quantity of discharge liquid, is optimized for minimization of power consumption required for excavation by using the excavator of this invention.

13 Claims, 8 Drawing Sheets

ELECTROPULSE METHOD OF HOLES BORING AND BORING MACHINE

TECHNICAL FIELD

This invention relates to electropulse method of holes boring and boring machine. In other words, this invention relates to excavation of a solid insulating matter, mining of oil and gas and civil engineering and construction work.

BACKGROUND ART

Excavation methods and excavators using electric pulses are known hitherto. For example, optimization for crush of a rock mass and a man-made structure by means of electric pulses is described by Vajor V. F., Siomkin B. V., Adam A. M., "Physics Vol. 4", Tomsk Polytechnic University 1996.

According to this known excavation method, a bore top is placed on a rock mass in a discharge liquid. High-voltage pulses are applied to electrodes at intervals of microsecond to allow electric discharge pass through the rock mass so as to fracture and crush it. The time required for the rock mass to be fractured is determined by a length between the electrodes. The drawback to this method is that the interval between the electrodes is only one parameter for increasing excavating efficiencies.

Another conventional type of excavator comprises a high-voltage pulse generator, a bore pipe, and a bore top. The bore pipe includes an outer earth pipe and an inner high-pressure pipe arranged concentrically and has the bore top at the tip end. The drawback to this excavator is no equipment for setting optimum conditions for excavation.

Known as a still another known excavation method and excavator is "Material crush by means of electric pulses" written by B. V. Siomkin, A. F. Uthof, V. I. Bathes (on pages 7–11, 34–62, 220–224, 11–16 and 231–240, Nauka Press 1995).

According to this method of testing, a rock mass to be crushed is dipped into a liquid. The liquid serves as an insulator in a selected pulse range of high-voltage electric pulses. The electric pulses are applied to the electrodes placed on the rock mass to allow the electric discharge to occur in the rock mass dipped in the insulating fluid. The drawback of this method is that the optimum condition for the crushing of the rock mass is only effective for the rock mass existing between the two electrodes, which is thus largely different from excavation.

A yet another known excavator comprises a bore top, a bore pipe and a high-voltage power supply. This known excavator is provided with a guide at an entrance of a hole to be excavated and a lifting device. The discharge liquid in the hole is allowed to cycle to be led to a discharge reservoir. The high-voltage pulses are applied to a high-pressure pipe of the bore pipe.

The drawback to this known excavator is that the excavating hole is not so sufficient in structure as to reach the maximum efficiency.

In the light of the above-described drawbacks involved in the prior art, the present invention has been made. It is the object of the present invention to provide an excavation method and an excavator capable of excavating efficiently with a minimum power consumption.

DISCLOSURE OF THE INVENTION

The present invention provides an excavation method for crushing a matter to be excavated, existing in an excavating hole in which a discharge liquid is fed, by means of electric discharge between a plurality of electrodes generated by high-voltage pulses, wherein at least one of the following parameters for excavation efficiency is set to be an optimum value for minimization of power consumption required for excavation, before performing the excavation:

i) load voltage required for the crush of the matter to be excavated;

ii) single pulse energy; and iii) quantity of discharge liquid.

Specifically, for the load voltage required for crushing the matter to be excavated, possible optimum values of the load voltage required for crushing the matter to be excavated are estimated by the following Equation (1), followed by finding an optimum value of the load voltage required for crushing the matter to be excavated by varying the load voltage continuously or intermittently within a range of load voltages centered near those estimated load voltage values U1:

$$U1=K(1/n-1)^{0.15}\times U_0\times L^{0.4}[kv] \quad (1)$$

where

K: a coefficient, K=1.0–1.5 [$1/cm^{0.4}$];

n: the number of electrodes;

L: a length between the electrodes [cm]; and $U_0$: a value obtained by testing, or a voltage [kv] applied when a sample of the matter to be excavated existing in the discharge liquid is crushed via two electrodes having the length of 1 cm therebetween placed on the sample.

For the single pulse energy, possible optimum values of the single pulse energy are estimated by the following Equation (2), followed by finding an optimum value of the single pulse energy by varying the single pulse energy continuously or intermittently within a range of single pulse energies including the estimated optimum values $W_0$:

$$W_0>90L^{1.6}[J] \quad (2)$$

For the quantity of discharge liquid, possible optimum values of the quantity of discharge liquid are estimated by the following Equation (3), followed by finding an optimum value of the quantity of discharge liquid by varying the quantity of discharge liquid continuously or intermittently within a range of quantity of discharge liquid including those estimated optimum values Q of the quantity of discharge liquid:

$$Q=(0.25-0.5)\pi\times Db^2/4\times f\ [liter/min.] \quad (3)$$

where

Db: a diameter of a bore top [cm]; and f: the number of pulses per second (frequencies of pulse).

According to the excavation method of the present invention, since at least one of the parameters for excavation efficiencies, i) load voltage required for the crush of the matter to be excavated; ii) single pulse energy; and iii) quantity of discharge liquid, is set to be an optimum value for minimization of power consumption required for excavation, before performing the excavation, the power consumption can be kept at a minimum to make excavation with efficiency.

Further, since possible optimum values for minimization of power consumption of the parameters for the excavation efficiencies are estimated by the above Equations (1), (2), and (3) before attempts for excavation, the number of testing for finding an optimum value can be reduced to a minimum number, to find the optimum value with efficiency.

Also, the present invention provides an excavator 1 for crushing a matter to be excavated, existing in an excavating hole in which a discharge liquid is fed, by means of electric discharge between a plurality of electrodes generated by high-voltage pulses, the excavator comprising a high-voltage pulse generator; a plurality of electrodes, at least one of which is given a high voltage from the high-voltage pulse generator; discharge liquid circulating system; and optimum condition setting devices.

The optimum setting devices are connecting between the high-voltage pulse generator and the plurality of electrodes, or assembled in the discharge liquid circulating system, or connected between the high-voltage pulse generator and the plurality of electrodes and assembled in the discharge liquid circulating system, so that at least one of the following parameters for excavation efficiencies is optimized so that power consumption required for excavation can be minimized:i) load voltage required for the crush of the matter to be excavated;

ii) single pulse energy; and iii) quantity of discharge liquid.

According to the excavator of the present invention, since at least one of the parameters for excavation efficiencies, i) load voltage required for the crush of the matter to be excavated; ii) single pulse energy; and iii) quantity of discharge liquid, is optimized for minimization of power consumption required for excavation, the power consumption can be kept at a minimum to make excavation with efficiency.

Further, the excavator of the present invention includes a bore pipe connected to the high-voltage pulse generator at one end portion thereof and to the plurality of electrodes at the other end portion thereof, for conveying the high voltage to the electrodes between the high-voltage pulse generator and the plurality of electrodes. The bore pipe includes a high-voltage pipe and a ground pipe arranged concentrically outside of the high-voltage pipe, and an inside of the ground pipe and an outside of the high-voltage pipe of the bore pipe are plated with a non-magnetic and high conductive material.

The plating with such a non-magnetic and high conductive material contributes to significant reduction of the phenomenon that with an increase in depth of the excavating hole, a pulse rise time increases and a voltage amplitude decreases. By virtue of this, the pulse conditions need not be changed so often, thus enabling the stable operation of the excavator.

In addition, the excavator of the present invention includes a guide, arranged around the bore pipe, for guiding the bore pipe into underground. The bore pipe and the guide are connected with each other through a sliding contact point so that the bore pipe can slide vertically within the guide.

The contact point via which the bore pipe and the guide are connected with each other prevents a possible breakdown of air gap resulting from the electric potential difference between the guide and the bore pipe.

Also, in the excavator of the present invention, a high-voltage pulse power circuit for generating the high-voltage pulses is a high-voltage pulse power circuit of inductor capacitor type in which an inductor capacitor and a semi-conductor rectifier are combined.

As compared with a conventional type of excavator in which the semi-conductor rectifier is not used in the power circuit, this type of power circuit has the advantages that the form and weight can be cut in half to enable movement of the excavator and, further, the number of capacitors and sphere gaps are reduced and also the voltage in the capacitor can be lowered, thus increasing the life of the high-voltage pulse power circuit.

Further, in the excavator of the present invention, there is provided a lifting device having a lifting means for moving the bore pipe up and down, and a high-voltage input portion for inputting a high voltage to the bore pipe is arranged at one end portion of the bore pipe inclined from an axis of the bore pipe at a predetermined angle.

This inclined arrangement of the high-voltage input portion can facilitate a connection of the lifting means of the lifting device, such as the wire, to the bore pipe, as compared with the embodiment of the high-voltage input portion arranged coaxially on the bore pipe. This can facilitate the setting and lifting of the bore pipe in and from the excavating hole by means of the lifting device without paying particular attention to a contact between the high-voltage input portion and the wire. Further, this enables the bore pipe to be moved in the excavating hole by means of the lifting device.

In addition, the excavator of the present invention includes a bore pipe including a high-voltage pipe and a ground pipe arranged concentrically outside of the high-voltage pipe, for conveying the high voltage to the electrodes between the high-voltage pulse generator and the plurality of electrodes, the bore pipe being connected to the high-voltage pulse generator at one end portion thereof and to the plurality of electrodes at the other end portion thereof. Also, an outer surface of a high-voltage input portion for inputting the high voltage to the bore pipe is coated with a semi-conductive material and is electrically connected with the ground pipe.

The high-voltage input portion thus coated with the semi-conductive material can withstand more load voltage, as compared with the one coated with no semi-conductive material.

Also, the excavator of the present invention includes a discharge mud collecting device fixed to the bore pipe. The discharge mud collecting device has discharge liquid feeding passageways which are formed by pipes having a segment section and arranged concentrically with the bore pipe; and collecting passageways which are formed by grooves defined between the discharge liquid feeding passageways and in which a plurality of elastic valves are arranged along a direction of the discharge mud being collected.

With this structured discharge mud collecting device, even when the speed allowing the discharge mud to be collected comes to be insufficient, the discharge mud is dropped onto the elastic valves and thus the back flow is avoided. Further, since the collecting passageways are grooves defined between the discharge liquid feeding passageways, not any pipes intended for collecting use, large fragments dropped on the elastic valves can easily be crushed or pulverized by a known technique. This can eliminate a possible fear, involved in the known discharge mud collecting device having a collecting passageway formed by a pipe or equivalent, that the collecting passageway may be blocked by large fragments, to cause damage of the collecting pipe and others, which may in turn cause damage of the discharge mud collecting device itself.

Further, the excavator of the present invention includes a bore top having a plurality of electrodes, at least one of which is given a high voltage from the high-voltage pulse generator; and a bore pipe, having one end portion to which the high-voltage pulse generator is connected and the other end portion to which the bore top is threadedly fixed, for conveying the high voltage to the electrodes between the high-voltage pulse generator and the bore top. A threaded portion of the bore top is provided with a horizontally extending aperture having a predetermined length and two detents arranged in the horizontally extending aperture. Also, a length between the two detents is rendered shorter than the predetermined length of the horizontally extending aperture, in order to allow the bore top to rotate around its axis.

The bore top provided with the horizontally extending aperture and the detents can be allowed to rotate around its axis. By virtue of this, the bore top and its joint portions are prevented from being twisted by a shock wave from excavation and an impact from the discharge mud. Thus, the bore top is kept at its specified position by the bottom, thus producing an enhanced efficiency of the excavation of the rock mass.

Additionally, in the excavator of the present invention, the bore top is provided with the electrodes on points of intersection of grid and is movable in the excavating hole.

With this arrangement of the electrodes being arranged on points of intersection of grid, the electric discharge occurs on the grid and, as a result, the crush occurs also in part of the rock mass protruded in the part enclosed in the grid, so that the rock mass is crushed with efficiently. Also, with the arrangement of the bore top being movable, holes having different diameters can be excavated by moving the bore top.

Also, in the excavator of the present invention, the high-voltage electrodes and other electrodes to which the high voltage is input are bent at their ends so that one can extend toward the other with respect to each other.

The electrodes having this structure are suitable for excavation of a matter to be excavated having a core of a large diameter.

BEST MODE FOR CARRYING OUT THE INVENTION

Figure 1:
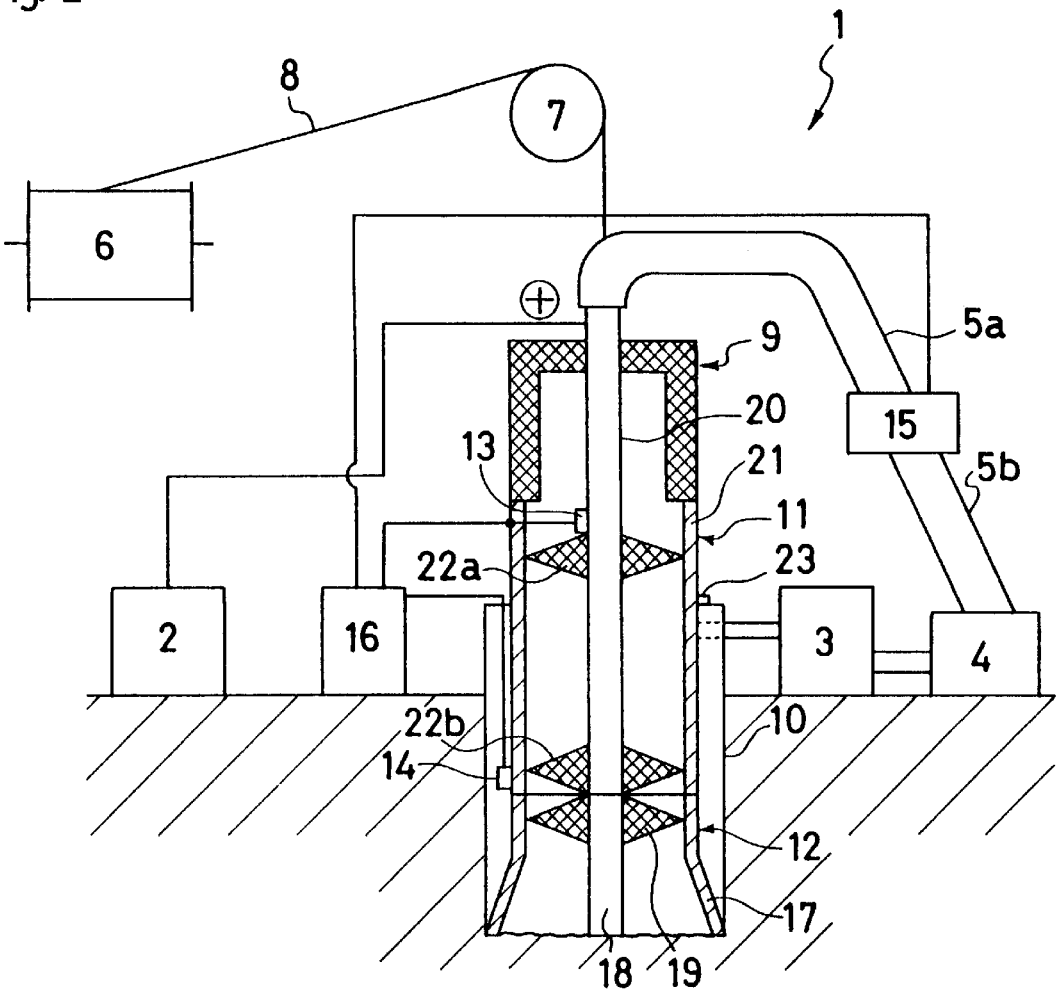
FIG. 1 is a showing of a construction of an excavator of the present invention.

The excavation method of the present invention will be described specifically.

(i) First, $U_0$ is determined by use of a sample of a matter to be excavated: where $U_0$ is the voltage [kV] applied when the sample is crushed by the electric discharge from two electrodes having a length of 1 cm therebetween placed on the sample of the matter to be excavated existing in the discharge liquid.

Micro quartzite (Mineral name: rock crystal) was used as a sample of the material to be excavated. The sample was dipped in diesel oil. The two electrodes were placed on the sample. The length between the electrodes was then set to be cm. One of the electrodes was grounded and the other of the electrodes was loaded in high voltage.

The sample was crushed five times under the same conditions. It is noted that whatever kinds of samples are used, five to ten times of testing are required. Also, in the case of non-uniform samples, the number of samples used should preferably be further increased for testing.

After five times of crushing of samples, a mean value of $U_0$=190 [kV] was obtained.

Then, excavation of the rock mass was made using an excavator having electrodes of 7 in number (n) and 4 cm in each length L therebetween. The load voltage U1 of 252.8–379.3 [kV] was then given by Eq. (1). The excavation was performed while the power consumption W was measured, with the load voltage varied intermittently or continuously within the range of load voltage of 220.0–490.0 [kV] centered about those values. The results are as shown in TABLE 1. At the load voltage U1 of 380 [kV], the power consumption W was minimized.

According to the excavation method of the present invention, the excavation was made using the optimum load voltage value U1 at which the power consumption W was minimized. For simplicity, the optimum load voltage value U1 should first be selected before the excavating work and the selected optimum value should then be maintained constant throughout the excavating work. For further enhanced efficiency, the step that the load voltage is varied within the range of load voltages including the load voltage value U1 given by Eq. (1), to find an optimum load voltage for the power consumption W to be minimized should be performed at regular intervals or continuously during the operation of the excavator, so that the excavation can always be made at the optimum load voltage for the power consumption W to be minimized.

TABLE 1

| | | | | | | | | | |
|---|---|---|---|---|---|---|---|---|---|
| U1 [kV] | 220 | 250 | 280 | 320 | 360 | 380 | 400 | 440 | 490 |
| W [J/cm$^3$] | No discharge | 310 | 280 | 240 | 200 | 175 | 180 | 205 | 250 |

Now, a further detailed description on TABLE 1 will be given here.

The crush of the rock mass was taken place at the rising of the pulse. The crush of the rock mass was dependent on some parameters, the main of which was a voltage across the electrodes. For U1=220 kV, no discharge was found and thus the rock mass was not crushed. For U1 larger than that, electric discharge was observed, but the probability of the rock mass being crushed by the discharge penetration was not more than 100%.

It was found that the voltage rise increased the probability of the discharge penetration and thus the probability of the crush. However, in many cases, the excavation in the condition of the energy being most consumed does not always maximize the probability of the discharge penetration. Increase in dielectric breakdown and reduction in reliability of a pulse voltage generator can be cited as the reasons therefor. This is why the maximum efficiency is achieved at close to the maximum U1 in the instructed Eq. (1), i.e., 379.3 [kV].

In fact, the energy consumption for the crush of the rock mass was minimized at 380 [kV], as shown in TABLE 1. Under this condition, the breakdown voltage was thought to achieve the maximum efficiency. A main reason why the power consumption increased for U1>380 kV is the re-crush of the discharge mud.

(ii) Then, with the load voltage taken as 380 [kV] and the length between the electrodes taken as 4 cm and also with single pulse energy varied continuously or intermittently in the range of 250 to 1,550 [J], the excavation of sandstone was performed while the power consumption W was measured. The single pulse energy was varied by varying capacitance of the pulse voltage generator.

It was found that the single pulse energy given by Eq. (2) of $W_0 \geqq 90L^{1.6}$ was included in the range of the single pulse energy of 250 to 1,550 [J]. The results are as shown in TABLE 2. The power consumption W was minimized when the single pulse energy $W_0$ was in the range of 880 to 1,100 [J].

According to this excavation method of the present invention, the excavation is performed by using the optimum single pulse energy value $W_0$ at which the power consumption W is minimized. For simplicity, the optimum single pulse energy value $W_0$ should first be selected before the excavating work and the selected optimum value should then be maintained constant throughout the excavating work. For further enhanced efficiency, the step that the single pulse energy is varied within the range of single pulse energies including the single pulse energy $W_0$ given by Eq. (2), to find an optimum single pulse energy for the power consumption W to be minimized should be performed at regular intervals or continuously during the operation of the excavator, so that the excavation can always be made at the optimum single pulse energy for the power consumption W to be minimized.

TABLE 2

| $W_0$ [J] | 250 | 400 | 650 | 880 | 1100 | 1400 | 1550 |
|---|---|---|---|---|---|---|---|
| W [J/Sec.] | 300 | 230 | 190 | 180 | 180 | 250 | 280 |

Now, a further detailed description on TABLE 2 will be given here.

An excavation condition as properly set can allow the excavation efficiency to increase and also allow the necessary energy for the crush to reduce. This will clearly be seen from TABLE 2. The increase of the single pulse energy $W_0$ caused reduction of the power consumption W. Further, when the single pulse energy $W_0$ was increased, the power consumption W was increased due to the re-crush of the discharge mud. The power consumption can be reduced by ⅔ or less by determining the maximum efficiency of the discharge energy from the pulse power source.

(iii) Then, with the single pulse energy taken as 850 [J]; the length between the electrodes taken as 4 cm; the diameter of the bore top taken as 110 [mm]; and the pulse frequency f taken as 1 to 9, the quantity Q of discharge liquid was calculated. The reason why the pulse frequency f was taken as 1 to 9 is that while the rate of excavation is directly proportional to the pulse frequency f in the range of 1 to 9 per second, reduction of the excavation efficiency is caused when the frequency is increased further. With the quantity of discharge liquid varied continuously or intermittently within the range of the quantity of discharge liquid including the value given by Eq. (3) above, the excavation of rock crystal was performed while the then power consumption W was measured. As a result, the quantity Q of discharge liquid of 450 [liter/min.] was found to be optimum.

In this excavation method of the present invention, the excavation is performed by using the optimum quantity Q of discharge liquid for the power consumption W to be minimized. For simplicity, an optimum quantity Q of discharge liquid should first be selected before the excavating work and the selected optimum value should then be maintained constant throughout the excavating work. For further enhanced efficiency, the step that the quantity of discharge liquid is varied within the range of quantities of discharge liquid including the quantity Q of discharge liquid given by Eq. (3), to find an optimum quantity of discharge liquid for the power consumption W to be minimized should be performed at regular intervals or continuously during the operation of the excavator, so that the excavation can always be made at the optimum quantity of discharge liquid for the power consumption W to be minimized.

Referring now to FIGS. 1 to 8, the excavator of the present invention will be described.

(Structure of Excavator)

In FIG. 1, an excavator 1 is composed of a high-voltage pulse generator 2, bore portions 9, 10, 11 and 12, discharge liquid circulating system 3, 4, 5*a* and 5*b*, optimum condition setting devices 13, 14, 15 and 16, and lifting devices 6, 7 and 8.

The bore portions include a high-voltage input portion 9, a bore pipe 11, a guide 10, arranged around the bore pipe 11, for guiding the bore pipe 11 into underground, and a bore top 12 provided at the tip end of the bore pipe 11.

The bore pipe 11 is composed of a high-voltage pipe 20 and a ground pipe 21 arranged concentrically outside of the high-voltage pipe 20 and is so structured as to be slidable vertically within the guide 10. The high-voltage pipe 20 and the ground pipe 21 are partitioned by intermediate insulators 22*a*, 22*b*. The inside of the ground pipe 21 and the outside of the high-voltage pipe 20 are plated with a non-magnetic and high conductive material. The non-magnetic and high conductive materials which may be used include duralumin, copper, brass and aluminum. This plating is given for the purpose of suppressing a phenomenon that with an increase in depth of a hole to be excavated, pulse rise time increases and a voltage amplitude decreases. The order of not more than 0.1 mm is an enough thickness for the plating.

The guide 10 and the ground pipe 21 are connected with each other through a sliding contact point 23 so that the ground pipe 21 can slide vertically within the guide 10. This is because a discharge circuit of the high-voltage pulse generator 2 and the bore portion is not necessarily required to be grounded, but the guide 10 and ground pipe 21 are required to be connected to each other.

The discharge between a ground electrode 17 and a high-voltage electrode 18 may act to the discharge liquid as well, so that when a voltage exists between the guide 10 and the ground pipe 21, the breakdown of air gap may sometimes occur. In order to protect the discharge circuit of the high-voltage pulse generator 2 and the bore portion from the breakdown of air gap, the guide 10 and the ground pipe 12 are thus required to be connected to each other through the sliding contact point 23.

The bore top 12 is composed of the ground electrode 17 and the high-voltage electrode 18. The ground electrode 17 and the high-voltage electrode 18 are partitioned by a bore top insulator 19. The number of ground electrode 17 and high-voltage electrode 18 is not limited to the only one for each, as discussed later.

The discharge liquid circulating system includes a discharge liquid reservoir 3, a discharge liquid pump 4 and discharge liquid pipes 5*a*, 5*b*. The discharge liquid circulating system allows the discharge liquid to circulate, passing from the discharge liquid reservoir 3 through the pump 4 and the discharge liquid pipes 5*a*, 5*b* to the bore portion and returning therefrom through the gap between the outside of the ground pipe 21 and the excavating hole and through the guide 10 to the discharge liquid reservoir 3.

An optimum condition setting device includes a load-voltage-and-others adjusting device 13 for adjusting the load voltage, the single pulse energy or equivalent; a power consumption measuring device 14 such as a pulse current transformer; a discharge liquid control device 15; and an optimum-condition-setting control device 16 for setting optimum condition. The optimum-condition-setting control device 16 is connected with the load-voltage-and-others adjusting device 13, the power consumption measuring device 14, and the discharge liquid control device 15. This optimum-condition-setting control device 16 operates to optimize the excavation conditions at regular intervals or continuously so that the power consumption can be minimized. The parameters for optimization of the excavation conditions include a load voltage required for the crush of rock mass, a single pulse energy and a quantity of discharge liquid.

The discharge liquid control device 15 is assembled in between the discharge liquid pipes 5*a*, 5*b* and controls the parameters of the discharge liquid at regular intervals or continuously in accordance with the optimum-condition-setting control device 16. The parameters of the discharge liquid include properties of fluid (e.g. mechanical properties including volume conductivity, flow rate and structure) and operating circumstances.

The lifting device includes means for lifting the bore pipe 11, such as a winch 6, a pulley 7 and a wire 8.

Now, operation of the thus structured excavator 1 will be described. The bore portion is set in a bottom of an excavating hole so that the bore pipe 11 can be guided into underground by means of the guide 10. The discharge liquid is allowed to circulate by the discharge liquid circulating system, passing from the discharge liquid reservoir 3 through the pump 4 and the discharge liquid pipes 5*a*, 5*b* to the bore portion and returning therefrom through the gap between the outside of the ground pipe 21 and the excavating hole and through the guide 10 to the discharge liquid reservoir 3. The high-voltage pulse is applied from the high-voltage pulse generator 2 to the high-voltage pipe 20 and the high-voltage electrodes 18 in the bore top through the high-voltage input portion 9. The electric discharge is produced between the high-voltage electrode 18 and the ground electrode 17. The electric discharge passes through the rock mass and thereby the rock mass is crushed. The crushed rock mass is removed from the excavating hole, together with the discharge liquid, by means of the discharge liquid circulating system.

Then, the lifting device lowers the bore portion downward to reset it in a newly formed bottom of the excavating hole. The bore pipe 11 is then guided into underground by the guide 10, while it is slid downward along an inner wall of the guide 10. The operations above are repeated for the excavating work to proceed.

During the operations, the load voltage, the single pulse energy and the quantity of discharge liquid required for the crush of rock mass are determined at regular intervals or continuously by the optimum-condition-setting control device 16 so that the power consumption can be minimized. The properties of fluid (e.g. mechanical properties including volume conductivity, flow rate and structure) and the operating circumstances are determined by the discharge liquid control device under the instruction from the optimum-condition-setting control device.

Thus, according to the excavator 1 of the present invention, since the excavating conditions required for the crush of rock mass, such as the load voltage, the single pulse energy and the quantity of discharge liquid, are optimized at regular intervals or continuously by the optimum-condition-setting control device so that the power consumption can be minimized, the excavation can be performed efficiently in compliance with natural conditions.

Also, since the inside of the ground pipe 21 and the outside of the high-voltage pipe 20 are plated with a non-magnetic and high conductive material, the phenomenon that with an increase in depth of the excavating hole, pulse rise time increases and a voltage amplitude decreases can be suppressed significantly. This can provide the result that the pulse conditions need not be changed so often, thus enabling the stable operation of the excavator.

Further, since the guide 10 and the ground pipe 21 are connected with each other through the sliding contact point 23 at the outlet side of the discharge liquid, a possible breakdown of air gap resulting from the electric potential difference between the guide 10 and the ground pipe 21 can be avoided.

The excavator 1 of the present invention is applicable not only to excavation of a solid insulating matter such as a rock mass but also to a mining of oil and gas and a civil engineering and construction work. Thus, the matter to be excavated is not limited to the rock mass.

(High-voltage pulse power circuit)

Figure 2:
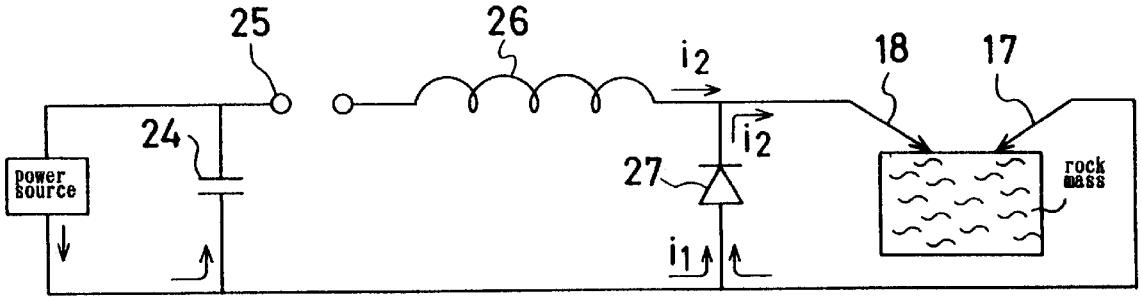
FIG. 2 is a showing of a power circuit of the excavator of the present invention.

A high-voltage pulse power circuit used in the excavator 1 of the present invention will be described with reference to FIG. 2. This circuit is a high-voltage pulse power circuit of inductor capacitor type using a semi-conductor rectifier. The high-voltage pulse power circuit includes a high-voltage capacitor 24, a sphere gap 25, an inductor capacitor 26 and a semi-conductor rectifier 27 such as a diode. In the diagram, the electrodes 17, 18 of the bore top 12 and the rock mass are also shown.

The high-voltage pulse power circuit acts in the following manner. When the power source is connected in parallel with the high-voltage capacitor 24, a voltage is accumulated in the high-voltage capacitor 24. The current i1 which tends to flow toward one electrode 17 of the bore top 12 is then led to the inductor capacitor 26 by means of the diode 27, so that the voltage is accumulated and thus increased in the inductor capacitor 26 as well. When the voltage enough to operate the sphere gap 25 is accumulated in the high-voltage capacitor 24, a breakdown occurs in the sphere gap 25 and the high-voltage pulse power circuit is energized. When the high-voltage pulse power circuit is energized, the high-voltage current increased in the inductor capacitor 26 and the current from the diode 27 flow to the other electrode 18 of the bore top 12, as shown by an arrow i2 in the diagram. Then, the discharge is generated between the electrodes 17, 18 of the bore top 12 and thereby the rock mass is crushed. The operations above are repeated.

It is noted that the time interval required for the diode 27 to interrupt the current to the electrode 17 of the bore top 12 so that the voltage enough to operate the sphere gap 25 can be accumulated in the high-voltage capacitor 24 is as little as nanosecond. The voltage in the inductor capacitor 26 is increased within this little time interval. This increase of voltage can be increased by 3 to 3.5 times as high as the load voltage to the high-voltage capacitor 24 by setting the conditions such as impedance adequately.

The high-voltage pulse power circuit thus constructed by combination of the inductor capacitor 26 and the diode 27 provides the following advantages, as compared with a conventional type of excavator in which the diode 27 is not used in the power circuit. The form and weight can be cut in half, thus enabling movement of the excavator; and the number of capacitors and sphere gaps is reduced and also the capacitor voltage can be lowered, thus increasing the life of the high-voltage pulse power circuit.

Also, the use of the inductor capacitor and the solid-state rectifier enables the pulse power source to be further reduced in form and size, as compared with the conventional type one, thus enabling those to be positioned in the bore, particularly, in the vicinity of the bore top. Accordingly, the pulse power circuit of inductor capacitor type can be dipped in the bore top in the excavating hole. This is an important part when a deep hole is excavated, particularly when a discharge liquid high in electric conductivity, such as water, is used.

The single pulse energy can be varied by varying the capacitance.

(High-voltage input portion)

Figure 3:
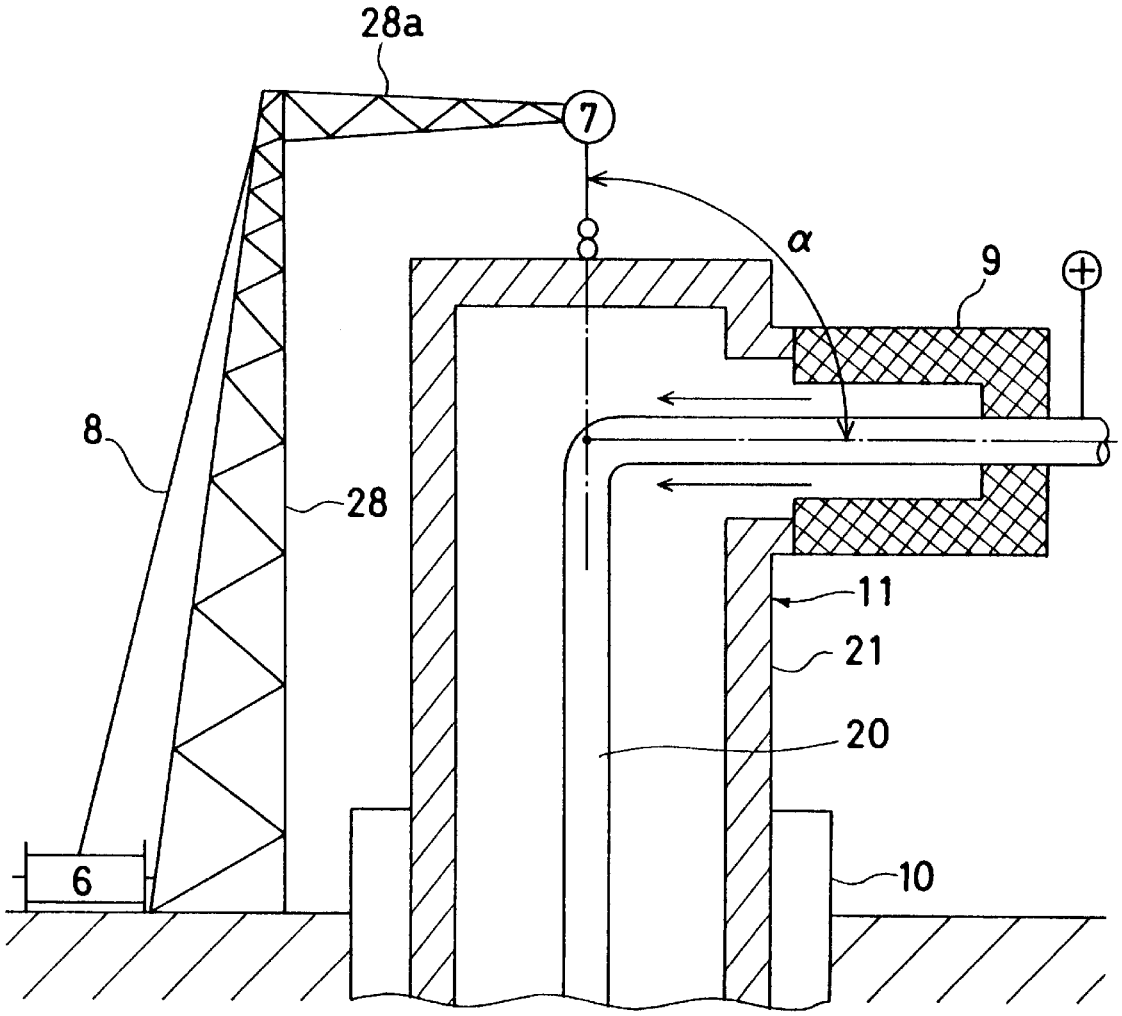
FIG. 3 is a showing of a mounting position of a high-voltage input portion of the excavator of the present invention.
Figure 4:
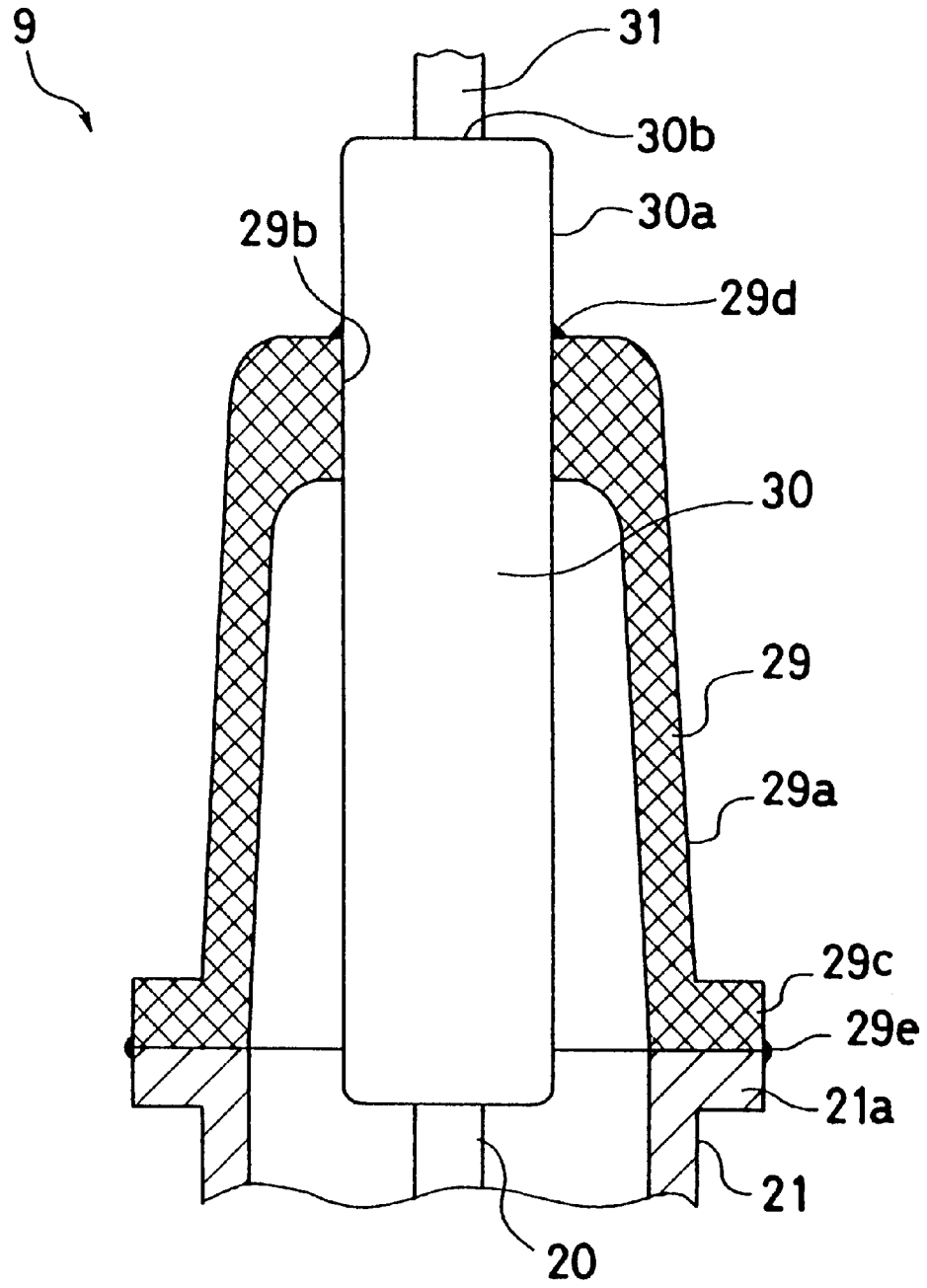
FIG. 4 is an illustration of the structure of the high-voltage input portion of the excavator of the present invention.

Referring now to FIGS. 3 and 4, a preferable mounting position and structure of the high-voltage input portion 9 of the excavator of the present invention will be described.

In FIG. 3, a support 27, the winch 6 and the wire 8 form the lifting device. In the excavator of the present invention, the high-voltage input portion 9 is arranged inclined from the axis of the bore pipe an at a predetermined angle $\alpha$. It is preferable that the predetermined angle $\alpha$ is in the range of $30° < \alpha < 150°$ with respect to the axis of the bore pipe 11.

The wire 8 of the lifting device is connected to the bore pipe can The bore pipe 11 is guided into underground by means of the guide 10, so as to move up and down along the guide 10.

This inclined arrangement of the high-voltage input portion 9 can facilitate a connection of the wire 8 of the lifting device to the bore pipe 11, as compared with the embodiment of the high-voltage input portion 9 arranged coaxially on the bore pipe 11. This can facilitate the setting and lifting of the bore pipe 11 in and from the excavating hole by means of the lifting device without paying particular attention to a contact between the high-voltage input portion 9 and the wire 8. Further, this enables the bore pipe 11 to be moved in the excavating hole even by means of the lifting device.

With reference to FIG. 4, the structure of the high-voltage input portion 9 will be described. In FIG. 4, reference numeral 29 designates an insulating part. The insulating part 29 has an inverted cup-like form having a through hole 29*b* at the bottom. The cup-like formed insulating part 29 is provided with a flange 29*c* around an opening thereof. The flange 29*c* is connected to a flange 21*a* of the ground pipe 21 of the bore pipe.

A high-voltage wire 30 is housed in the insulating part 29, with its upper end portion inserted and fixed in the through hole 29*b* in such a manner as to project a little from the through hole 29*b*. A current cable 31 is connected to the upper end 30*b* of the high-voltage wire 30, and the high-voltage pipe 20 of the bore pipe is connected to the lower end of the same.

The insulating part 29 is coated with a semi-conductive material by applying the semi-conductive material on at least an outer surface 29*a* thereof. The surface 29*a* of the insulating part 29 coated with the semi-conductive material and the ground pipe 21 of the bore pipe have an electric contact point 29*e* at their flanges 21*a*, 29*c*. Similarly, the high-voltage wire 30 is also coated with the semi-conductive material by applying the semi-conductive material on a surface 30*a* thereof. The surface 30*a* of the high-voltage wire 30 coated with the semi-conductive material and the surface 29*a* of the insulating part 29 coated with the semi-conductive material have the electric contact point 29*d* at a fixing portion of the insulating part 29 to the high-voltage wire 30. The semi-conductive materials which may be used include a mixture of solvent such as polyethylene and graphite and a composite material.

The high-voltage input test was performed by use of the high-voltage input portion 9 constructed above. The insulating part 29 and the high voltage wire 30 of high-density polyethylene were used. The high-voltage wire 30 had a diameter of 4 mm and a height of 220 mm. The current cable 31 had a diameter of 15 mm. The flange 29*c* of the insulating part 29 had a diameter of 160 mm.

A resistance between the contact points 29*e* and 29*d* on the semi-conductivity material coated surface 29*a* was 1.2 kΩ, and a resistance between the upper end 30*b* of the high-voltage wire 30 which is the connecting surface with the current cable 31 and the contact point 29*d* was also 1.2 kΩ. This means that the total electric resistance of the semi-conductive material coated surfaces 30*a* and 30*b* was 2.4 kΩ.

Then, a test voltage was applied between the high-voltage pulse generator and the current cable, and the test voltage was increased stepwise to 350 kV–880 kV. The time intervals at which the voltage pulses were applied were set at 1.5 microsecond. It was then found that the high-voltage input portion 9 coated with the semi-conductive material withstood 2.7 times more load voltage, as compared with the one coated with no semi-conductive material.

(Discharge mud collecting device)

Figure 5A:
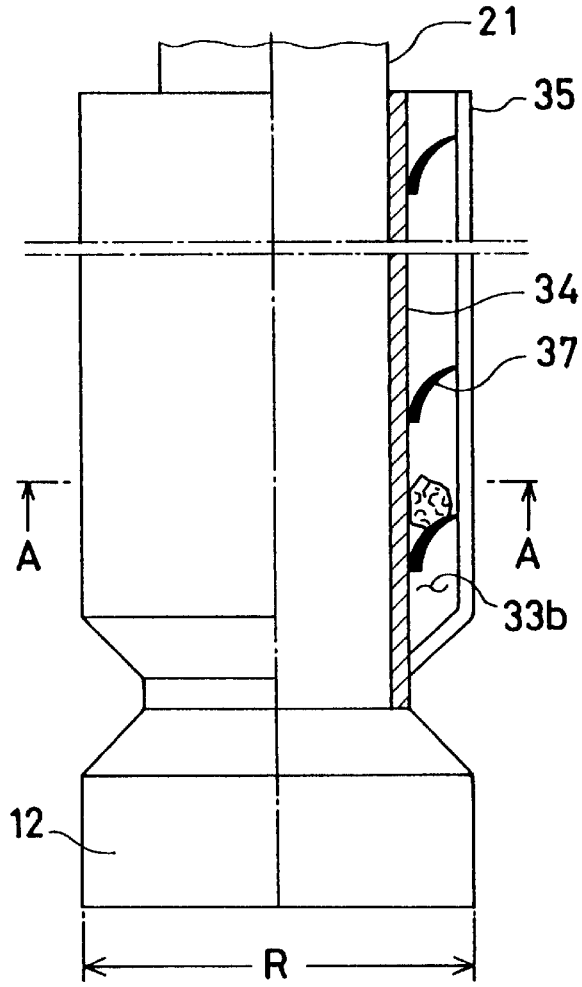
FIG. 5(*a*) and FIG. 5(*b*) are illustrations of a discharge mud collecting device forming a discharge liquid circulating system.
Figure 5B:
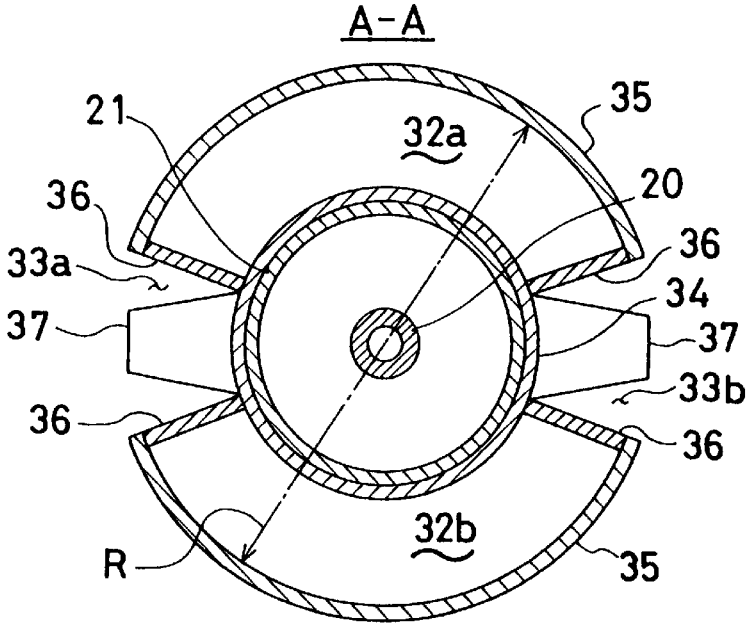

Referring now to FIGS. 5(*a*) and 5(*b*), the discharge mud collecting device forming the discharge liquid circulating system will be described. FIGS. 5(*a*) and 5(*b*) are a showing of the discharge mud collecting device mounted to the bore pipe and a sectional view of the same, respectively. In the diagrams, R designates the diameter of the bore top.

The discharge mud collecting device has two discharge liquid feeding passageways 32*a*, 32*b* and two collecting passageways 33*a*, 33*b* for the discharge mud to be pumped together with the discharge liquid, as shown in FIG. 5(*b*).

The two discharge liquid feeding passageways 32*a*, 32*b* are spaces of a segment section defined by an inner pipe 34 arranged concentrically with the ground pipe 21 of the bore pipe; two outer walls 35 of a circularly arc section located at a radially outer side of the inner pipe 34; and four partition walls 36 projecting radially outwardly from the inner pipe 34 to connect the two outer walls 35 with the inner pipe 34.

The two collecting passageways 33*a*, 33*b* are grooves defined between the two discharge liquid feeding passageways 32*a*, 32*b*. Thus, the discharge mud collecting device is so designed as to form the collecting passageways, without using any pipes intended for collecting use.

As shown in FIG. 5(*a*), a plurality of valves 37 of elastic material such as rubbers formed on the inner pipe 34 are vertically arranged in the two collecting passageways 33*a*, 33*b*.

Now, operation of the thus structured discharge mud collecting device will be described. After the matter to be excavated, such as a rock mass, is crushed, the fragments of the excavated matter such as the rock mass are mixed in the discharge liquid fed from the two discharge liquid feeding passageways 32*a*, 32*b*, resulting in the discharge mud. The discharge mud is pumped up through the two collecting passageways 33*a*, 33*b* by a pump located on the ground.

When the speed allowing the discharge mud to be pumped up is sufficient, even a large fragment is pumped up passing through the elastic valves 37. On the other hand, even when the speed allowing the discharge mud to be pumped up decreases suddenly or comes to be insufficient, the discharge mud is dropped onto the elastic valves 37 and thus the back flow is avoided. Further, since the two collecting passageways 33*a*, 33*b* are grooves defined between the two discharge liquid feeding passageways 32*a*, 32*b*, not any pipes intended for collecting use, large fragments dropped on the elastic valves 37 can be crushed or pulverized by a known technique.

This can eliminate a possible fear, involved in the known discharge mud collecting device having a collecting passageway formed by a pipe or equivalent, that the collecting passageway may be blocked by large fragments, to cause damage of the collecting pipe and others, which may in turn cause damage of the discharge mud collecting device itself.

Where the length between the electrodes is set to be not less than 100 mm as a property of the electric pulse excavation, there is a possibility of the discharge mud being crushed into large fragments. However, the discharge mud collecting device discussed above prevents the pipes or equivalent for the collecting passageways from being destroyed even when the speed at which the discharge mud is pumped up is decreased suddenly or the collecting passageways are blocked by the large fragments.

(Mounting structure of the bore top)

Figure 6:
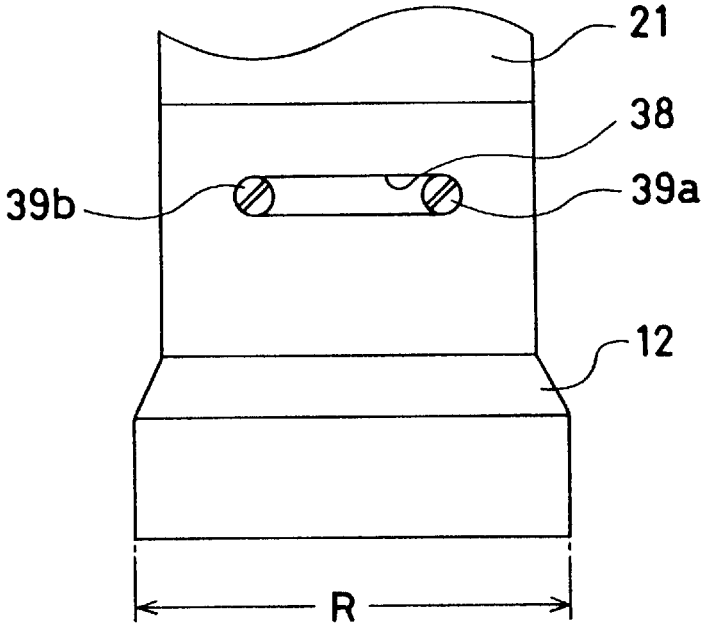
FIG. 6 is a schematic diagram of a mounting structure of the bore top to the bore pipe.

FIG. 6 is a schematic diagram of a mounting structure of the bore top 12 to the bore pipe 11 In the diagram, R designates a diameter of the bore top.

The bore top 12 is threadedly fixed to the ground pipe 21 of the bore pipe 11 at the tip end. A horizontally extending aperture 38 having a predetermined length is formed in a thread portion of the bore top 12. Two detents 39*a*, 39*b* are provided in the horizontally extending aperture 38.

The length between the two detents 39*a*, 39*b* is rendered shorter than a length of the horizontally extending aperture 38, in order to allow the bore top 12 to rotate around its axis. The length which allows the bore top 12 to rotate around its axis is determined by the difference between the length of the horizontally extending aperture 38 and the length between the two detents 39*a*, 39*b*. The difference should preferably be the length between the electrodes and above.

The reason for the provision of the horizontally extending aperture 38 is as follows.

In the process of the excavation, the bore top 12 is subjected to a shock wave and an impact from the discharge mud. As a result of this, the bore top 12 is susceptible to bending and may sometimes be twisted. However, since the bore top 12 is provided with the horizontally extending aperture 38 which can allow the bore top to rotate around its axis, it is prevented from being twisted. Then, the bore top 12 is kept at its specified position by the bottom. This produces an enhanced efficiency of the excavation of the rock mass. The efficiency was improved by 20%, as compared with the bore top having no horizontally extending aperture 38.

(Number of electrodes of the bore top and Movement of the bore top around a center axis of a hole to be excavated)

It is one of the important factors for reduction of excavation costs what kind of discharge liquid should be used. If water is used as a discharge liquid low in cost, for example, since water has high electric conductivity, a considerable amount of leakage current is produced between the electrodes. In view of this, reduction of the number of electrodes is significant. However, excavation of a hole of a large diameter had a limitation in reduction of the number of electrodes.

Figure 7:
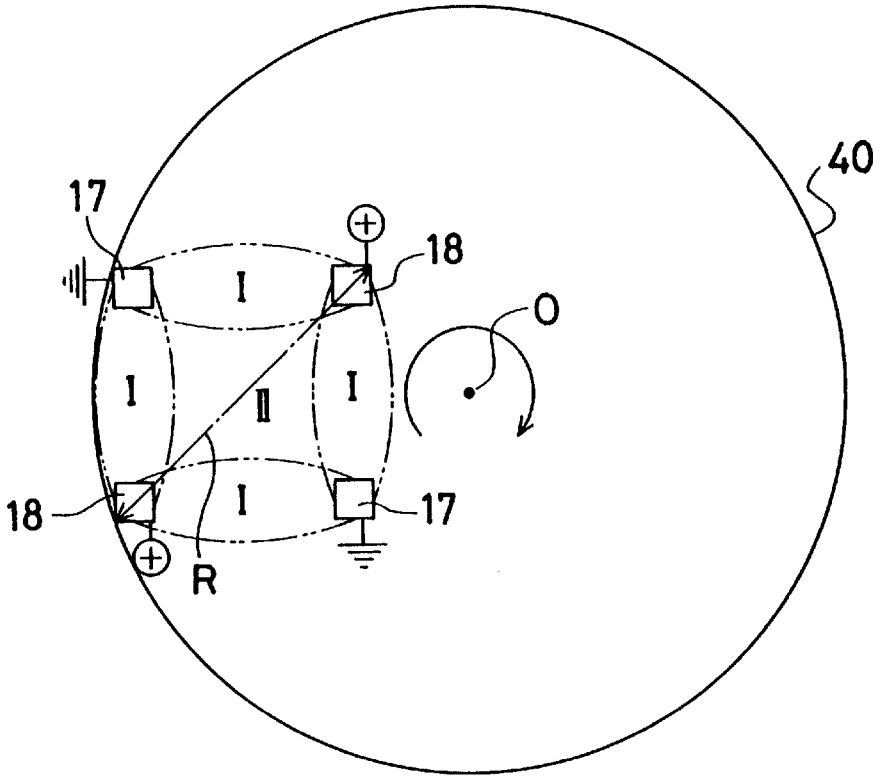
FIG. 7 is a showing of an electrode structure of the bore top.
Figure 8:
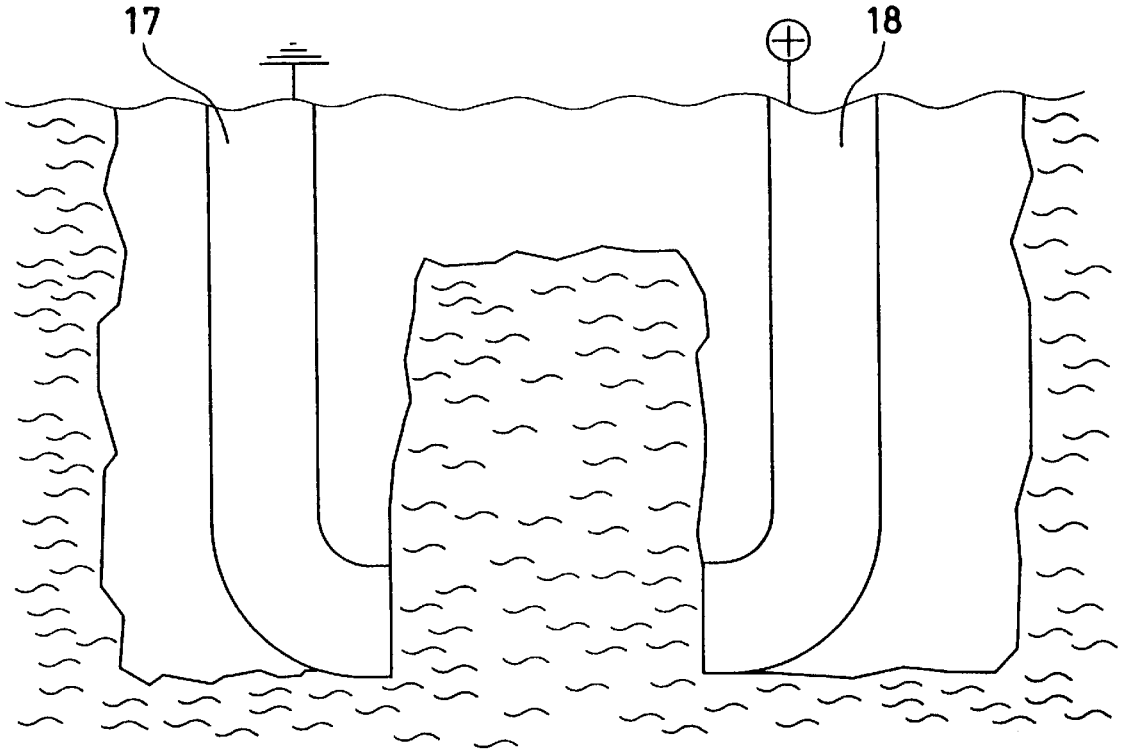
FIG. 8 is a showing of a structure of tip ends of the electrodes.

Shown in FIG. 7 is the electrode structure of the bore top which is capable of reducing the number of electrodes to a minimum while having a capability of excavating a hole of a large diameter.

The bore top is composed of two high-voltage electrodes 18 and two ground electrodes 17. The electrodes are positioned on points of intersection of grid. In this embodiment in which the bore top has four electrodes, the electrodes are positioned at the vertexes of a square. Thus, the electrode arrangement is rectangular, so that the bore top takes the maximum diameter R.

The bore top thus structured is movable around an axis O of the excavating hole. The movement of the bore top can be effected by a flow of discharge liquid or an electric discharge energy. Alternatively, modification may be made such as, for example, making the arm 28*a* at the end of the support 28 of the lifting device shown in FIG. 3 extendable and contractable horizontally as well as pivotable around the support 28 at 90° so that the arm can be moved together with the bore pipe 11 to reliably move the bore top to a specified position.

Operation of the bore top thus structured will now be described. In the bore top having the structure discussed above, the electric discharge occurs in the parts I enclosed by two-dotted lines and, as a result, the crush occurs in part of the rock mass protruded in the part II enclosed in the parts I, so that the rock mass is crushed with efficiently. Then, the bore top is moved in the direction of an arrow around the axis O of a hole 40 to be excavated. The excavating work is started again in the place to which the bore top is moved and simultaneously a boring work is performed in the place from which the bore top is moved. Thus, with the bore top moved around the axis O of the hole to be excavated, holes having different diameters can be excavated.

The prior art usually requires the number of electrodes by several times for the excavation of the hole 40 of such a large diameter, and accordingly the leak current is increased by several times and the efficiency is reduced significantly.

(End structure of the electrode)

It is hard to make an excavation of a matter to be excavated having a core of a large diameter. The end structure of the electrode suitable for such an excavation of the matter to be excavated having a core of a large diameter is shown in FIG. B. The high-voltage electrode 18 and the ground electrode 17 are bent at their ends so that one can extend toward the other with respect to each other. The bending angle should preferably be not more than 90°.

The electrodes having this end structure crushed a central core having a diameter of 600 mm at 100 pulses in total. The excavation efficiency was improved by 30*e* by this method.

(Optimization of excavation conditions)

Next, it is described specifically how the excavation conditions were optimized in the excavator 1 of FIG. 1. The length between the electrodes was set at 4 cm.

In this excavation method, the single pulse energy for minimizing the power consumption W must be determined with respect to the load voltage U1 for minimizing the power consumption W. This also means the determination of an optimum value of a capacitance C of the pulse voltage generator for minimizing the power consumption W with respect to the load voltage U1 for minimizing the power consumption W, because the single pulse energy is varied by varying the capacitance of the pulse voltage generator.

Figure 9:
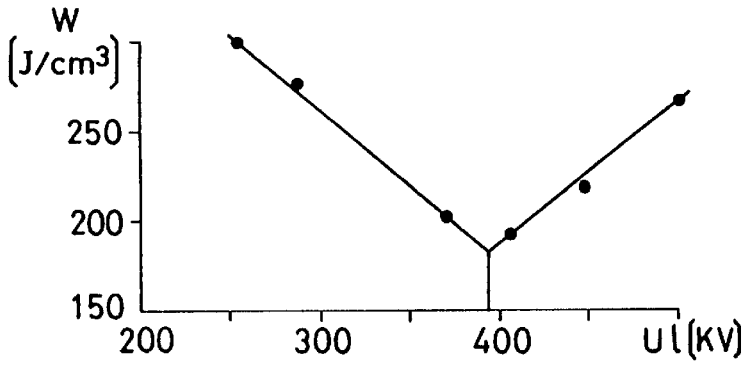
FIG. 9 is a graph plotting a power consumption W with respect to a load voltage U1.

FIG. 9 is a graph plotting the electric power consumption W with respect to the load voltage U1. Possible values of the load voltage U1 at which the power consumption W may be minimized were estimated by Eq. (1) which is one of the excavation methods of the present invention. Then, with the load voltage varied intermittently in the range of load voltages of 250–500.0 [kV] including those estimated values, the power consumption W was measured. The power consumption W was reduced to the minimum at the load voltage U1 of 370–390 [kV]. Then, the load voltage U1 was set at 370 [kV].

Figure 10:
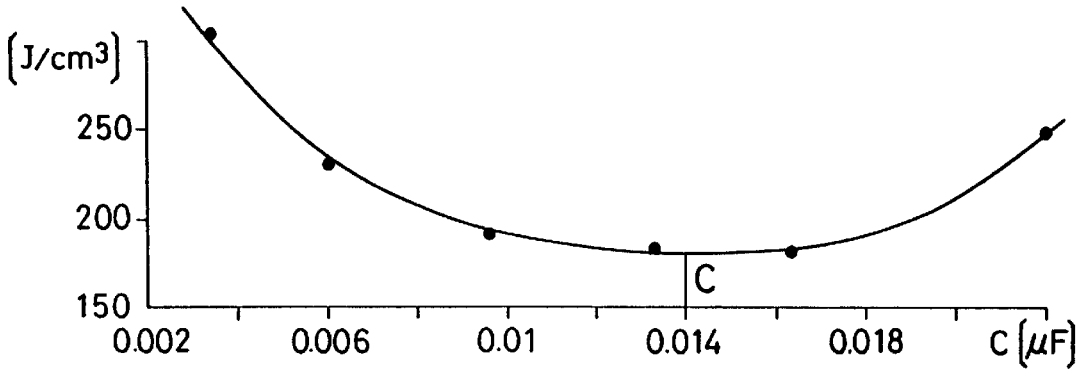
FIG. 10 is a graph plotting the power consumption W with respect to the capacitance C of a pulse voltage generator when the load voltage U1 is set at 370 [kV]

FIG. 10 is a graph plotting the power consumption W with respect to the capacitance C of the pulse voltage generator where the load voltage U1 is set at 370 [kV]. Possible values of the single pulse energy $W_0$ at which the power consumption W may be minimized were estimated by Eq. (2) which is one of the excavation methods of the present invention. Then, with the capacitance C of the pulse voltage generator, at which those single pulse energy $W_0$ is produced, varied intermittently in the range of the capacitance C centered near those estimated values, the power consumption W was measured. The power consumption W was reduced to the minimum at the capacitance C of 0.014 [$\mu$F]. Thus, when the length between the electrodes was L=4 [cm], the optimum conditions of the load voltage being U1=370 [kV] and the capacitance C of the pulse voltage generator being C=0.014 [$\mu$F] were found.

Then, when the load voltage U1 was set at 70 [kV] and the capacitance C of the pulse voltage generator was set at 0.014 [$\mu$F], the quantity Q of discharge liquid which can allow the power consumption W to be minimized was determined by Eq. (3) and others to optimize the quantity Q of discharge liquid.

It is noted that even when the length between the electrodes is set at a value other than 4 [cm], the optimum values of the load voltage, the capacitance C of the pulse voltage generator and the quantity Q of discharge liquid can be obtained.

Figure 11:
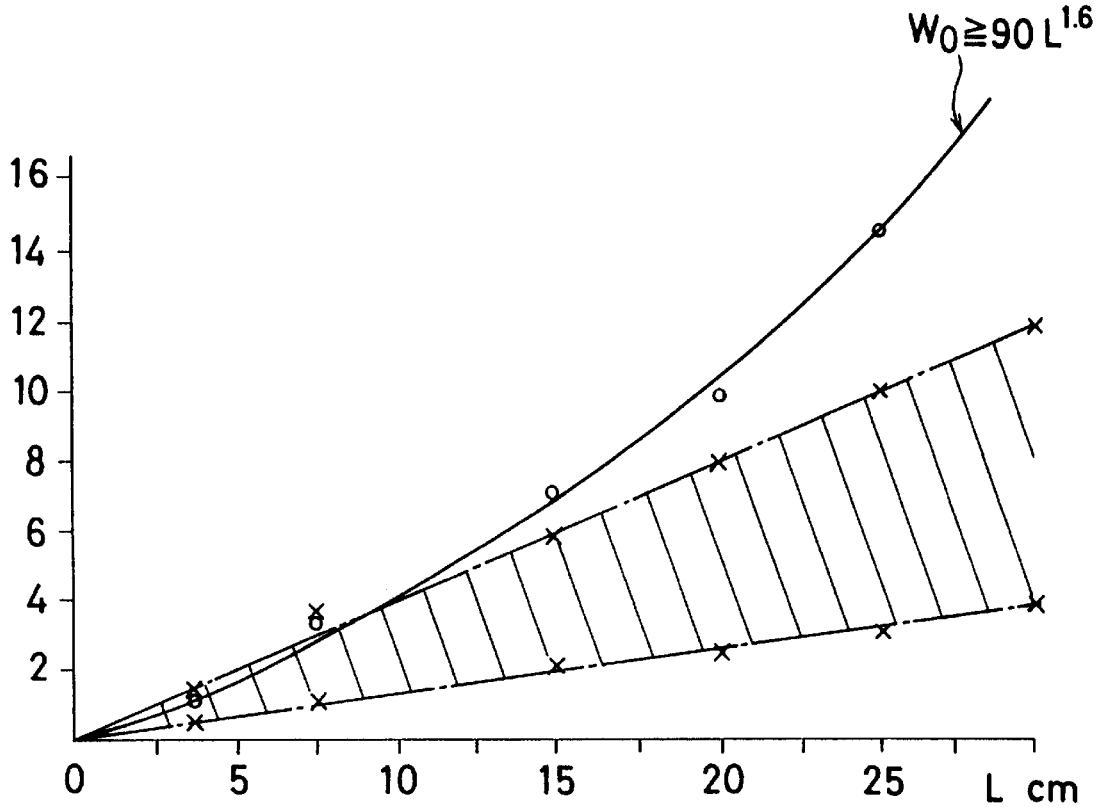
FIG. 11 is a graph plotting a single pulse energy with respect to a length L between the electrodes.

For reference purposes, a graph plotting the single pulse energy with respect to the length L between the electrodes is shown in FIG. 11. Illustrated therein is a graph of Eq. (3) of $W_0 \geqq 90L^{1.6}$ as an index for the optimum conditions. The diagonally shaded range in the diagram shows an energy required for the rock mass to be crushed by the electric pulses, as taught by patent to Cretz, Dolzon, et al. (Dated: Sep. 13, 1995).

Capabilities of Exploitation in Industry

The present invention is best applicable as the excavation method and the excavator capable of making excavation efficiently with a minimum power consumption.

What is claimed is:

1. An excavation method for crushing a matter to be excavated, existing in an excavating hole in which a discharge liquid is fed, by means of electric discharge between a plurality of electrodes generated by high-voltage pulses, characterized in that at least one of the following parameters for excavation efficiency is set to be an optimum value for minimization of power consumption required for excavation, before performing the excavation:

i) load voltage required for crushing said matter to be excavated;

ii) single pulse energy; and iii) quantity of discharge liquid.

2. An excavation method as set forth in claim 1, wherein an optimum value of said load voltage required for crushing said matter to be excavated is found by varying said load voltage continuously or intermittently within a range of load voltages including a load voltage value U1 given by the following Equation:

$$U1=K(1/n-1)^{0.15}\times U_0\times L^{0.4}\ [kv] \quad (1)$$

Where

K: a coefficient, K=1.0–1.5 [$1/cm^{0.4}$];

n: the number of electrodes;

L: a length between the electrodes [cm]; and $U_0$: a value obtained by testing, or a voltage [kv] applied when a sample of the matter to be excavated existing in said discharge liquid is crushed via two electrodes having the length of 1 cm therebetween placed on said sample.

3. An excavation method as set forth in claim 1, wherein an optimum value of said single pulse energy is found by varying said single pulse energy continuously or intermittently within a range of single pulse energies including a single pulse energy $W_0$ given by the following Equation:

$$W_0>90L^{1.6}\ [J] \quad (2)$$

4. An excavation method as set forth in claim 1, wherein an optimum value of said quantity of discharge liquid is found by varying said quantity of discharge liquid continuously or intermittently within a range of quantity of discharge liquid including quantity Q of discharge liquid given by the following Equation:

$$Q=(0.25-0.5)\pi\times Db^2/4\times f\ [liter/min.] \quad (3)$$

Where

Db: a diameter of a bore top [cm]; and f: the number of pulses per second (frequencies of pulse).

5. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2;

a plurality of electrodes 17, 18, at least one of which is given a high voltage from said high-voltage pulse generator 2;

discharge liquid circulating system 3, 4, 5*a*, 5*b*; and optimum condition setting devices 13, 14, 15, 16, said optimum setting devices 13, 14, 15, 16 being connecting between said high-voltage pulse generator 2 and said plurality of electrodes 17, 18, or assembled in said discharge liquid circulating system 3, 4, 5*a*, 5*b*, or connected between said high-voltage pulse generator 2 and said plurality of electrodes 17, 18 and assembled in said discharge liquid circulating system 3, 4, 5*a*, 5*b*, so that at least one of the following parameters for excavation efficiency is optimized so that power consumption required for excavation can be minimized:

i) load voltage required for crushing said matter to be excavated;

ii) single pulse energy; and iii) quantity of discharge liquid.

6. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2;

a plurality of electrodes 17, 18, at least one of which is given a high voltage from said high-voltage pulse generator 2; and a bore pipe 11, including a high-voltage pipe 20 and a ground pipe 21 arranged concentrically outside of said high-voltage pipe 20, for conveying said high voltage to said electrodes between said high-voltage pulse generator 2 and said plurality of electrodes 17, 18, said bore pipe being connected to said high-voltage pulse generator 2 at one end portion thereof and connected to said plurality of electrodes at the other end portion thereof, wherein an inside of said ground pipe 21 and an outside of said high-voltage pipe 20 of said bore pipe 11 are plated with a non-magnetic and high conductive material.

7. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2;

a plurality of electrodes 17, 18, at least one of which is given a high voltage from said high-voltage pulse generator 2;

a bore pipe 11, connected to said high-voltage pulse generator 2 at one end portion thereof and to said plurality of electrodes at the other end portion thereof, for conveying said high voltage to said electrodes between said high-voltage pulse generator 2 and said plurality of electrodes 17, 18; and a guide 10, arranged around said bore pipe 11, for guiding said bore pipe 11 into underground, said bore pipe 11 and said guide 10 being connected with each other through a sliding contact point 23 so that said bore pipe 11 can slide vertically within said guide 10.

8. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2; and a plurality of electrodes 17, 18 at least one of which is given a high voltage from said high-voltage pulse generator 2, wherein said high-voltage electrodes 18 and other electrodes 17 to which said high voltage is input are bent at their ends so that one can extend toward the other with respect to each other.

9. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2;

a plurality of electrodes 17, 18, at least one of which is given a high voltage from said high-voltage pulse generator 2;

a vertically extending bore pipe 11, connected to said high-voltage pulse generator 2 at one end portion thereof and to said plurality of electrodes at the other end portion thereof, for conveying said high voltage to the electrodes between said high-voltage pulse generator 2 and said plurality of electrodes 17, 18; and a lifting device having a lifting means for moving said bore pipe 11 up and down, wherein a high-voltage input portion 9 for inputting a high voltage to said bore pipe 11 is arranged at one end portion of said bore pipe 11 inclined from an axis of said bore pipe 11 at a predetermined angle $\alpha$.

10. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2;

a plurality of electrodes 17, 18, at least one of which is given a high voltage from said high-voltage pulse generator 2; and a bore pipe 11, including a high-voltage pipe 20 and a ground pipe 21 arranged concentrically outside of said high-voltage pipe 20, for conveying said high voltage to said electrodes between said high-voltage pulse generator 2 and said plurality of electrodes 17, 18, said bore pipe being connected to said high-voltage pulse generator 2 at one end portion thereof and to said plurality of electrodes at the other end portion thereof, wherein an outer surface of a high-voltage input portion 9 for inputting said high voltage to said bore pipe 11 is coated with a semi-conductive material and is electrically connected with said ground pipe 21.

11. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2;

a plurality of electrodes 17, 18, at least one of which is given a high voltage from said high-voltage pulse generator 2;

a bore pipe 11, connected to said high-voltage pulse generator 2 at one end portion thereof and to said plurality of electrodes at the other end portion thereof, for conveying said high voltage to said electrodes between said high-voltage pulse generator 2 and said plurality of electrodes 17, 18; and a discharge mud collecting device fixed to said bore pipe 11, wherein said discharge mud collecting device has discharge liquid feeding passageways 32*a*, 32*b* which are formed by pipes having a segment section and arranged concentrically with said bore pipe 11; and collecting passageways 33*a*, 33*b* which are formed by grooves defined between said discharge liquid feeding passageways 32*a*, 32*b* and in which a plurality of elastic valves 37 are arranged along a direction of said discharge mud being collected.

12. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2;

a bore top 12 having a plurality of electrodes 17, 18 at least one of which is given a high voltage from said high-voltage pulse generator 2; and a bore pipe 11, having one end portion to which said high-voltage pulse generator 2 is connected and the other end portion to which said bore top 12 is threadedly fixed, for conveying said high voltage to said electrodes between said high-voltage pulse generator 2 and said bore top 12, wherein a threaded portion of the bore top 12 is provided with a horizontally extending aperture 38 having a predetermined length and two detents 39*a*, 39*b* arranged in said horizontally extending aperture 38, and wherein a length between said two detents 39*a*, 39*b* is rendered shorter than said predetermined length of the horizontally extending aperture 38, in order to allow said bore top 12 to rotate around its axis.

13. An excavator 1 for crushing a matter to be excavated, existing in an excavating hole in which a discharge liquid is fed, by means of electric discharge between a plurality of electrodes generated by high-voltage pulses, said excavator comprising:

a high-voltage pulse generator 2;

a bore top 12 having a plurality of electrodes 17, 18 at least one of which is given a high voltage from said high-voltage pulse generator 2; and a bore pipe 11, having one end portion to which said high-voltage pulse generator 2 is connected and the other end portion to which said bore top 12 is connected, for conveying said high voltage to said electrodes between said high-voltage pulse generator 2 and said bore top 12, wherein said bore top 12 is provided with said electrodes at points of intersection of grid and is movable in said excavating hole.

* * * * *